US007905758B2

(12) United States Patent
Millstein

(10) Patent No.: US 7,905,758 B2
(45) Date of Patent: Mar. 15, 2011

(54) SWINGING SPOKES KINETIC MAGNETIC AMUSEMENT DEVICE

(76) Inventor: Joshua Millstein, Seattle, WA (US)

( * ) Notice: Subject to any disclaimer, the term of this patent is extended or adjusted under 35 U.S.C. 154(b) by 370 days.

(21) Appl. No.: 12/172,231

(22) Filed: Jul. 12, 2008

(65) Prior Publication Data

US 2010/0009594 A1 Jan. 14, 2010

(51) Int. Cl.
*A63H 33/26* (2006.01)

(52) U.S. Cl. ..... 446/131; 446/129; 446/132; 446/133; 446/134; 446/135

(58) Field of Classification Search ..... 446/129, 446/131–135
See application file for complete search history.

(56) References Cited

U.S. PATENT DOCUMENTS

| | | | | | |
|---|---|---|---|---|---|
| 2,220,049 | A | * | 10/1940 | Dunmore | 40/426 |
| 3,478,466 | A | * | 11/1969 | Conner | 446/131 |
| 3,707,290 | A | * | 12/1972 | Birnkrant | 273/141 A |
| 3,717,951 | A | * | 2/1973 | Ljungdahl | 446/130 |
| 3,903,684 | A | * | 9/1975 | Wilson | 368/98 |
| 3,908,307 | A | * | 9/1975 | Jacobson | 446/133 |
| 3,955,315 | A | * | 5/1976 | Goodman | 446/133 |
| 4,011,674 | A | * | 3/1977 | Jacobson | 40/426 |
| 4,250,659 | A | * | 2/1981 | Ishiguro | 446/133 |
| 4,690,657 | A | * | 9/1987 | Lodrick, Sr. | 446/134 |
| 4,723,232 | A | * | 2/1988 | Beebe | 368/76 |
| 4,723,233 | A | * | 2/1988 | Beebe | 368/76 |
| 4,838,825 | A | * | 6/1989 | Hwang et al. | 446/136 |
| 5,026,314 | A | * | 6/1991 | Samson | 446/133 |
| 5,052,968 | A | * | 10/1991 | Lodrick, Sr. | 446/134 |
| 5,060,947 | A | * | 10/1991 | Hall | 273/138.2 |
| 5,085,434 | A | * | 2/1992 | Soto, II | 273/138.2 |
| 5,145,378 | A | * | 9/1992 | Rott et al. | 434/302 |
| 5,152,711 | A | * | 10/1992 | Gross | 446/139 |
| 5,182,533 | A | * | 1/1993 | Ritts | 335/306 |
| 5,483,764 | A | * | 1/1996 | Lin | 40/426 |
| 5,589,721 | A | * | 12/1996 | Han et al. | 310/90.5 |
| 7,234,986 | B2 | * | 6/2007 | Kowalski et al. | 446/92 |
| 2008/0163528 | A1 | * | 7/2008 | Soriano Ramos | 40/711 |

* cited by examiner

*Primary Examiner* — Alvin A Hunter
*Assistant Examiner* — Alexander R Niconovich

(57) ABSTRACT

A magnetically actuated amusement device includes a supporting structure having a fulcrum which pivotally supports rigid suspending elements each having a permanent magnet at its outer end. The magnetic swinging elements are arranged in an arc, sharing a common fulcrum, such that they will repel neighboring swinging elements in the arc, the motion of the swinging elements being constricted to swinging in the plane containing the arc.

3 Claims, 3 Drawing Sheets

SWINGING SPOKES KINETIC MAGNETIC AMUSEMENT DEVICE

REFERENCES CITED

U.S. Pat. No. 3,550,936 December 1970 Puttick
U.S. Pat. No. 3,621,424 November 1971 Query
U.S. Pat. No. 1,278,328 June 1972 GB
U.S. Pat. No. 3,717,951 February 1973 Ljungdahl
U.S. Pat. No. 4,011,674 March 1977 Jacobson
U.S. Pat. No. 5,026,314 June 1991 Samson

OTHER REFERENCES

"Hula-Balls", The Sunday Star, Washington, D.C., Dec. 15, 1968, p. A-37.

BACKGROUND OF THE INVENTION

1. Field of the Invention

The present invention relates to magnetic kinetic amusement devices wherein there is an intermittent interchange of motional energy between dynamic components by magnetic interactions.

2. Description of Prior Art

A variety of magnetic amusement devices and kinetic sculptures are known. In such devices, movable members are magnetically attracted or repelled by magnets on adjacent units to provide suspensory or motion effects. Often the objective is eye appeal, as for display purposes. For example, in the display apparatus of the Littlefield U.S. Pat. No. 3,196,566 a model airplane is suspended in air by magnetic repulsion between a magnet in the model and two spaced magnets in an underlying stationary base.

Other devices are characterized by magnetically imparted motion. Thus in the U.S. Pat. No. 2,220,049 to Dunmore, a pendulum-suspended figure is provided with a magnet that coacts with another magnet mounted below a platform. The sub-platform magnet may be fixed at a location offset from the pendulum rest axis, or may be driven through a circular or irregular path in a plane parallel to but beneath the platform. The suspended figure swings and rotates in some more or less random pattern under magnetic influence.

The magnetic amusement device of MacPherson (U.S. Pat. No. 3,550,316) uses a pair of pivotally supported, balanced rods each having a magnet at one end and a counterweight at the other end. Due to magnetic interaction, when one rotor is spun gently, rotation is imparted in the opposite direction to the other balanced rod. Depending on the speed of rotation, the interaction of the magnetic fields may result in the transfer of inertial energy as the magnet ends pass adjacent to each other causing changes in speed and sometimes reversal of direction of rotation.

In the Podesto kinetic sculpture of U.S. Pat. No. 3,609,606 a pair of magnets are attached to the free ends of a pair of artistically shaped spring wires that extend from a base. Repulsion between the magnets imparts random, tremor-like motion to the springs.

In the magnetic kinetic amusement device of Jacobson (U.S. Pat. No. 4,011,674) an embodiment includes magnetically interacting elements comprising pendulums each having at the pendulum end a design member containing a magnet. The plural pendulums may be disposed in a three dimensional array, or may be suspended from a common support with the magnets aligned for mutual repulsion so that the pendulums assume a conical arrangement. Displacement or rotation of any pendulum design member causes energy exchange through magnetic interactions.

The magnetic kinetic amusement device of Samson (U.S. Pat. No. 5,026,314) includes a supporting structure having side pieces which pivotally support rigid suspending elements each having a permanent magnet at its lower end. The magnets are arranged in a row, such that they will repel the next magnet in the row, the motion of the magnets being constricted to swinging in the vertical plane containing the row. As two adjacent magnets swing through an arc, they do not remain face to face but become more and more offset as they swing. There may be a point in the arc (depending on the dimensions) where they are approximately edge to edge and no longer repelling each other, but instead problematically drawn together by an attraction causing all motion to terminate. The resting position of the magnets is principally determined by gravity, thus when a magnet is set in motion it continues to swing back and forth until it eventually is at rest in a vertical position. This dynamic interplay between the forces of gravity and the magnetic fields of the magnets quickly leads to chaotic motion where all the magnets are swinging back and forth and irregularly repelling each other, i.e., the period of oscillation of each magnet changes often and in a seemingly random fashion that could be described as somewhat nervous.

Objects and Advantages

An object of the present invention is to provide magnetic kinetic amusement devices in which there is a continuing, but intermittent exchange of coherent motional energy between dynamic members, accomplished by magnetic interactions. The dynamic members radiate from a common fulcrum arranged similar to spokes on a wheel that radiate from a hub. This arrangement insures that, 1) the magnets will always be aligned face-to-face when they approach each other, maintaining and maximizing the repelling force; and 2) the resting position of each magnet will be determined more by the magnetic fields of the adjacent magnets than by gravity, resulting in more coherent motion. This motion may be such that the viewer is able to observe a compression wave traveling transversely along the series of magnets, reversing directions at the end of the series, and continuing on in this fashion with minimal degeneration into chaotic motion. The transfer of motion between magnets occurs with minimal sound and is much quieter than actual collisions between objects such as spheres, and thus less noise disturbance would result in areas, such as a work office, where a quiet atmosphere is maintained. The participant is able to initiate motion in many ways, and the resultant motional effects are fascinating to view. This invention, in demonstrating virtual collisions (the magnets do not actually touch), compression waves, oscillation, magnetism, and the gradual degeneration of kinetic energy into thermodynamic energy, may also prove to be a valuable teaching tool for physics students.

SUMMARY OF THE INVENTION

The apparatus of this invention comprises:

a supporting structure, at least two permanent magnets arranged in series, each magnet being suspended from the structure by means of a suspending element including pivot portions by which said element is pivotally mounted on the structure so as to pivot around a common fulcrum whereby each of the magnets in the series is displaceable both towards and away from its neighboring magnets in the series and is able to swing repeatedly back and forth;

each suspending element comprising rigid material extending from its pivot parts to its magnet, thereby constraining motion of its magnet only to swinging in a single plane of an arc extending along the series of said magnets;

each magnet being secured to its suspending element, with adjacent magnets in the series oriented and mounted to the common fulcrum such that mutual repulsion is maintained between them.

It will usually be desirable that the axis of each magnet (i.e. its North-South direction) will be aligned along the arc of the said series of magnets.

The strength of the magnets should be sufficient that swinging motion of one magnet is transmitted through the mutual repulsion to the next magnet(s) in the series, that is, sufficiently strong to insure that magnets moving towards each other will not normally touch.

With such an arrangement, motion of any one magnet sets the others in motion, and the motion is transmitted from end to end along the series.

As one magnet approaches another, the mutual repulsion retards the approaching magnet, but accelerates the other magnet to move away from the approaching magnet. Thus, the kinetic energy of a swinging magnet is transferred to the adjacent magnet through the magnetic field. Although the magnets do not touch, the effect is somewhat similar to a collision in that kinetic energy is transferred from one magnet to another. The effect is also somewhat different because the magnetic fields act at a distance so that the transfer of kinetic energy occurs during a section of the travel of the magnets along the arc rather than at the (single) point of contact as with the collision of non-magnetic bodies.

The motion described by the magnets when one of them is set swinging bears some resemblance to the behavior of a row of hard spheres, but without actual contact and without the associated sound of actual collisions. As one magnet approaches the next and repels it, the first magnet decelerates as the next accelerates, etc. with the motional exchange between magnets occurring in a less abrupt manner than materials that actually collide such as hard spheres.

The interaction of the magnets without one touching another is a striking sight. Another striking feature is the length of time during which motion will continue without any further impetus being given to the system. Motion has been observed to continue for much longer than with a row of hard spheres which undergo collision by touching.

Although the number of magnets in the series may be as few as two, it is desirable to employ at least three so that motion can be transmitted from one end of the series to the other through at least one magnet intermediately between the ends. The number of magnets preferably lies in the range from five to twenty, with ten being the most preferred number.

A very significant feature of the invention is the suspension of the magnets in a manner which constrains them to move only in a predetermined arc with a common fulcrum. This keeps them aligned and oriented to repel adjacent magnets and prevents them from jumping out of their intended paths of motion to positions at which two magnets can attract each other and become held to each other.

In a convenient constructional arrangement, the supporting structure includes a rod which functions as a fulcrum and around which each suspending element is pivotally mounted.

The suspending elements need to be sufficiently rigid to keep the magnets in their intended paths of movement. Convenient possibilities are a V-shape or U-shape, made from stiff, non-magnetic strips of sheet metal or stout wire with the upper extremities of the V or U pivotally mounted around the rod and the magnet secured to the base of the V or U.

Securing of the magnets to their suspending elements can be accomplished in various ways. One possibility is for them to be glued together with a blob of adhesive or resin. Another possibility is for each magnet to be surrounded by a casing molded in two parts which fit together and surround both the magnet and the lower part of its suspending element, thereby attaching them together. Alternatively, a molded plastic suspending element may include an integral mounting into which a magnet is held by a force fit.

DETAILED DESCRIPTION

Two embodiments of the invention will now be described in detail, with reference to the accompanying drawings, wherein.

Figure 1:
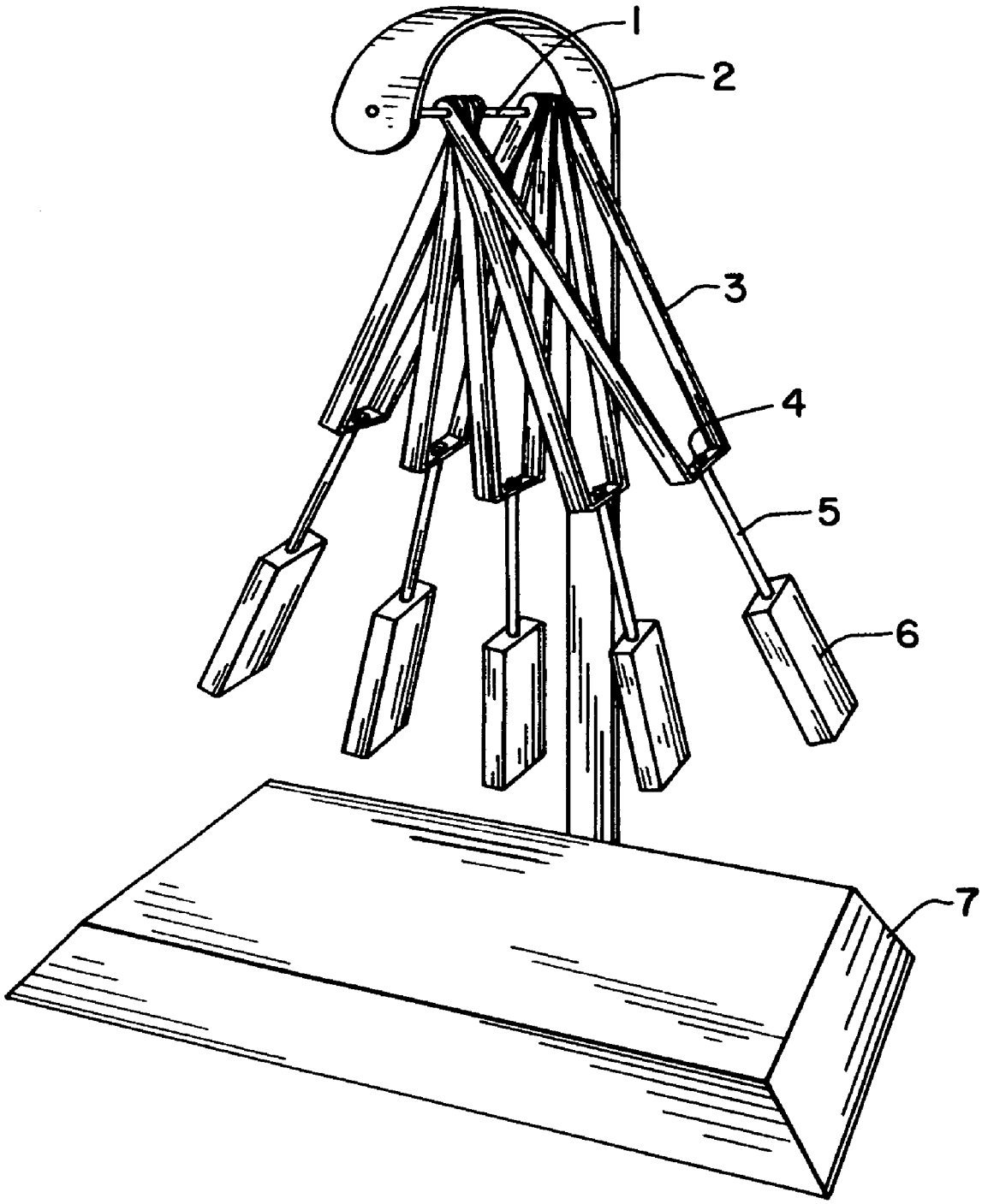
FIG. 1 is a perspective view of the preferred embodiment of the apparatus according to the invention.
Figure 2:
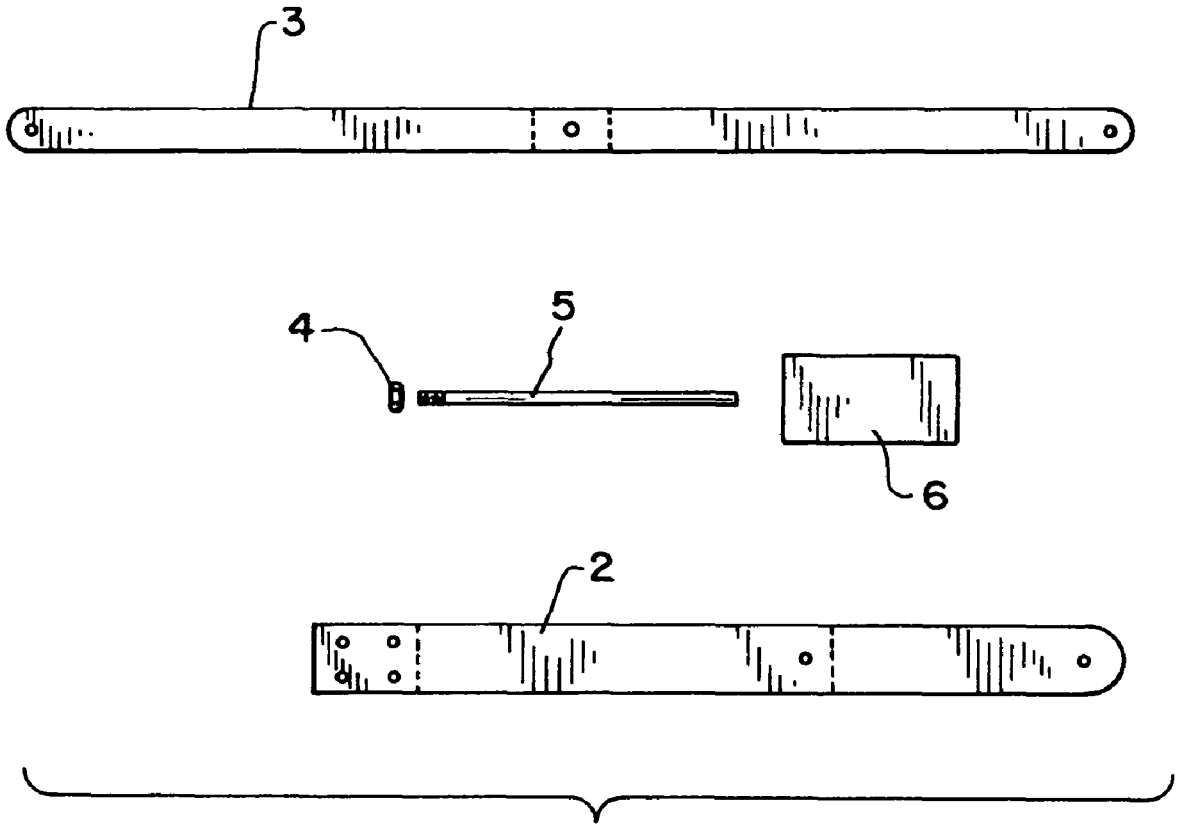
FIG. 2 is a top view of component parts needed to construct the swinging elements.

The apparatus has a supporting structure, referred to as a frame, shown generally as 2 in FIG. 1. The frame includes a vertical portion, which is attached to the base 7 at the bottom and bends around at the top to support the fulcrum 1. The frame is constructed from sheet metal or any other rigid material, such as plastic, wood, or stone that is sufficiently strong to support the fulcrum and the swinging elements. In FIG. 2, 2 shows a sheet metal cut-out of the frame element, which can be bent into the proper shape. The base is constructed of wood, but alternatively may be constructed of any material, such as metal, plastic, or stone that is sufficiently heavy and sturdy enough to immobilize the frame during movement of the swinging elements.

The pivot portion of the suspending element, 3 in FIG. 1, is suspended from the fulcrum by means of a hole at each end that is just large enough to allow the suspending element to rotate freely around the fulcrum. The pivot portions of the suspending elements have two points of contact with the fulcrum, thus constraining the movement of all swinging elements to the plane that is perpendicular to the fulcrum. Small Teflon washers are inserted on the fulcrum, between the upper ends of the suspending elements to decrease friction. A connecting rod portion of the suspending elements, 5 in FIG. 2, is fastened to the pivot portion by means of a fastening nut, 4. The connecting rod is attached to a magnet, 6, by a blob of adhesive or resin. The fulcrum is a steal rod, which is force fit into holes in the frame and thus securely attached to the frame.

The parts may be set in motion by moving any magnet, 6, or combination of magnets, resulting in a regular but complex motion that continues for some time until dampened by friction between the pivot portion of the suspending element, the Teflon washers, and the fulcrum as well as air resistance.

An alternative construction of the swinging element could omit the connecting rod altogether and attach the magnet directly to the pivot portion by means of adhesive or resin. An alternative mounting system for the suspending elements to the fulcrum is rotary bearings, which could be used by force fitting the bearings onto holes in the pivot portions.

Figure 3:
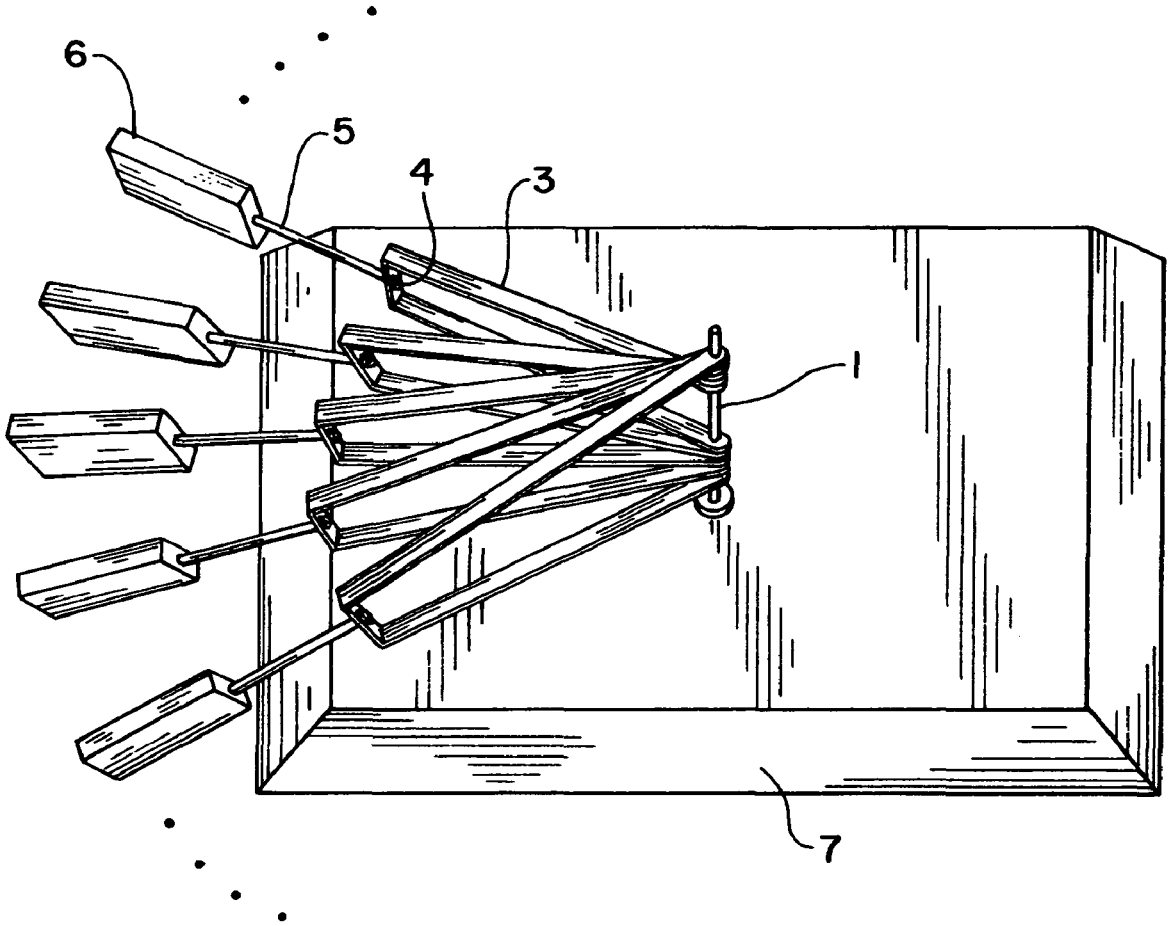
FIG. 3 is a perspective view of an alternative embodiment of the apparatus in which the swinging elements radiate laterally outward from a vertical fulcrum.

An alternative embodiment in FIG. 3 has the swinging elements radiating outward horizontally from a vertical fulcrum. In this embodiment, there is no frame, and the fulcrum is inserted directly into a hole in the base. It is preferable that there are an adequate number of swinging elements such that the arc of magnets completes a full circle and all magnets are weakly repelling their neighboring magnets when at rest.

Thus, the magnetic amusement device of the invention provides pleasurable coherent motion to viewers and participants of any age. The device also demonstrates many fundamental properties of physics such as the repellent forces of magnetism, transfer of kinetic energy from one object to another through the exertion of dynamic forces over time, wave motion, and the degeneration of coherent kinetic energy to thermodynamic energy.

I claim:

1. A kinetic magnetic apparatus for amusement, comprising:

A rigid supporting structure consisting of a base, a stand, and a rod;

a plurality of magnets whereby each magnet in said plurality is arranged in a series, and whereby movement of all magnets is constrained to a single common arc within a plane;

and whereby each magnet is independently mounted from the rod of the supporting structure by means of a rigid suspending element including pivot portions by which said element is pivotally mounted on said structure so as to pivot around said rod as a common fulcrum, whereby each of the magnets in the series is displaceable both towards and away from its neighboring magnets in the series and is able to oscillate repeatedly between neighboring magnets;

wherein all of the suspending elements extend radially away from the rod;

each said suspending element comprising rigid material extending from its pivot parts to its magnet, thereby constraining motion of its magnet only to swinging in a single plane of an arc extending along the series of said magnets;

each said magnet being secured to its suspending element, with adjacent magnets in the series oriented and mounted to the rod as the common fulcrum such that mutual repulsion is maintained between them.

2. Apparatus according to claim 1 wherein the axis of each magnet between the poles thereof is aligned along the arc of said series of magnets.

3. Apparatus according to claim 1 wherein each said suspending element independently articulates around said shared common fulcrum.

* * * * *